United States Patent [19]

Tokar

[11] 4,403,661

[45] Sep. 13, 1983

[54] AUTOMATIC SPRAY NOZZLE

[75] Inventor: Thomas Tokar, Garfield Heights, Ohio

[73] Assignee: A-T-O Inc., Willoughby, Ohio

[21] Appl. No.: 252,283

[22] Filed: Apr. 9, 1981

[51] Int. Cl.[3] ..... A62C 37/08

[52] U.S. Cl. ..... 169/38; 169/37

[58] Field of Search ..... 169/37, 38, 39, 40, 169/41; 239/498, 499, 504, 518

[56] References Cited

U.S. PATENT DOCUMENTS

| | | | |
|---|---|---|---|
| 1,028,940 | 6/1912 | Hunter | 169/37 |
| 2,495,208 | 1/1950 | Causer | 169/37 |
| 3,561,537 | 2/1971 | Dix | 169/37 |
| 4,099,675 | 7/1978 | Wohler | 169/37 |

*Primary Examiner*—Joseph J. Rolla
*Assistant Examiner*—Charles C. Compton
*Attorney, Agent, or Firm*—Harpman & Harpman

[57] ABSTRACT

An automatic spray nozzle for use in a fire extinguishing system includes an apertured body member, a closure cap, a frame supporting a novel deflector, and a cylindrical ferrule positioned below the novel deflector and spaced with respect thereto. A strut holds the closure cap and a lever bearing against the strut is releasably retained by a transversely disposed fusible element engaging spaced apertured arms on the strut. The combination of the cylindrical ferrule and the novel deflector including a conical portion provides a water distribution pattern which is much more uniform than the spray patterns produced by the prior art devices.

7 Claims, 3 Drawing Figures

AUTOMATIC SPRAY NOZZLE

BACKGROUND OF THE INVENTION (1) Technical Field

This invention relates to automatic spray nozzles of the type employed in fire extinguishing systems.

(2) Description of the Prior Art

Spray nozzles heretofore known in the art have utilized several variations of directional orifices and deflectors, some of the spray nozzles being so-called open nozzles and some being so-called automatic nozzles.

A typical prior art automatic nozzle is disclosed in U.S. Pat. Nos. 2,391,616 and 2,495,208, the construction being such that water directed through the nozzle is broken up into a fine spray which is sometimes termed fog. A sprinkler nozzle incorporating a ring-like deflector is disclosed in U.S. Pat. No. 1,028,940 and an outwardly flaring conical deflector is seen in U.S. Pat. No. 3,561,537. The strut holding the closure cap and the lever bearing against the strut and releasably retained by the transversely disposed fusible element is disclosed in U.S. Pat. No. 4,029,150.

The novelty in the present disclosure therefore resides in the configuration of the joint outer ends of the arms of the apertured body member and the positioning of the cylindrical ferrule in spaced relation thereto together with a deflector incorporating a conical body member and a plurality of outwardly flaring circumferentially spaced tines thereabout, the conical body member and the circumferentially spaced tines being spaced axially with respect to the cylindrical ferrule.

This invention provides a nozzle having a highly desirable spray pattern and which nozzle may be used as an open nozzle or as an automatic nozzle.

SUMMARY OF THE INVENTION

An automatic spray nozzle having an apertured body defining a fluid delivering passageway normally closed by a closure cap includes a frame positioning dual conical deflectors in spaced opposed relation to the fluid passageway together with a cylindrical ferrule positioned about the conical deflector and defining a novel annular configuration resulting in a more uniform distribution of water in a desired spray pattern.

A strut, lever and fusible element assembly is positioned between the deflectors and the closure cap when the device of the invention is formed as an automatic nozzle and the closure cap and strut, lever and fusible element assembly are omitted when the device of the invention is formed as an open nozzle.

DESCRIPTION OF THE PREFERRED EMBODIMENT

Figure 1:
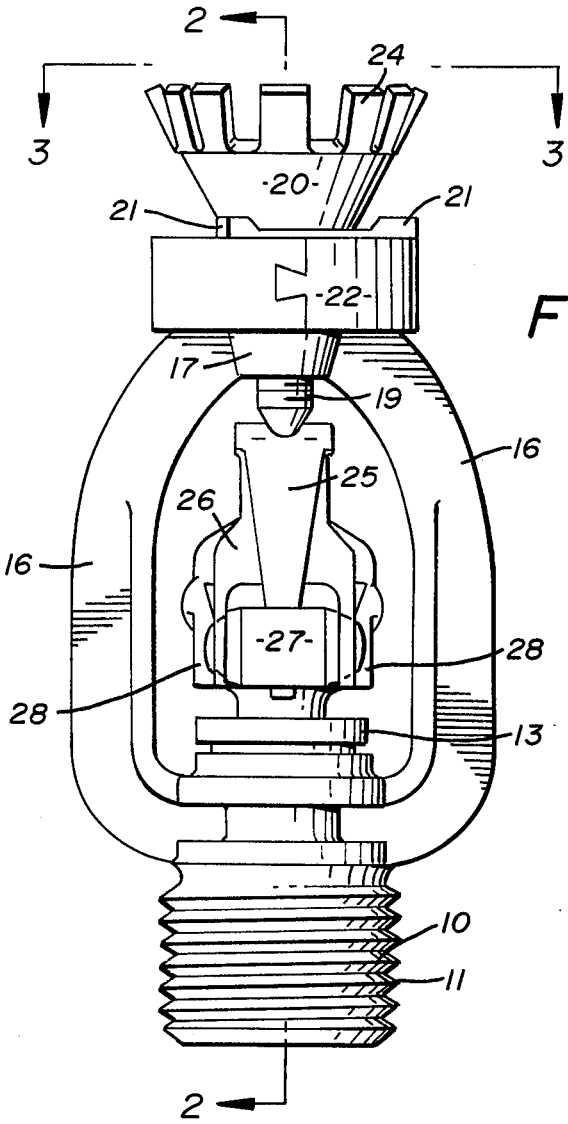
FIG. 1 is a side elevational view of an automatic spray nozzle embodying the present invention.
Figure 2:
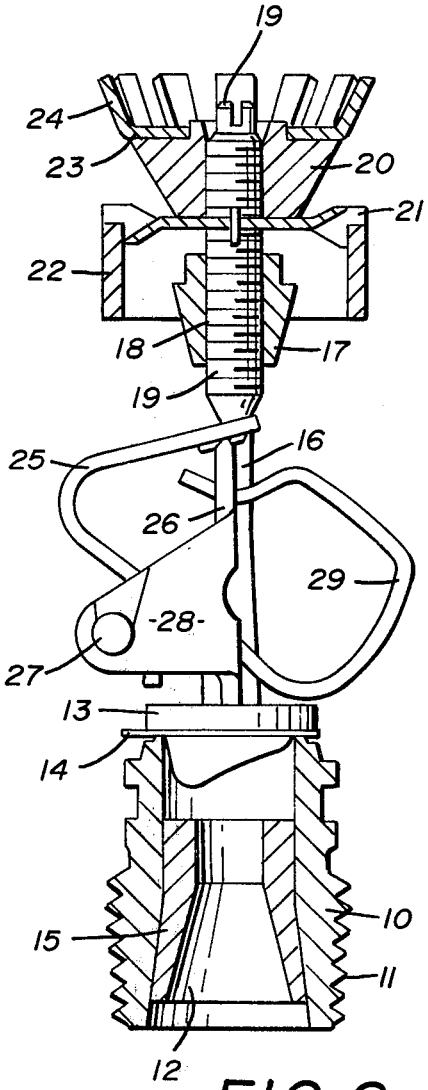
FIG. 2 is a vertical section on line 2—2 of FIG. 1.

In the form of the invention chosen for illustration herein and as best seen in FIGS. 1 and 2 of the drawings, the spray nozzle comprises an apertured body member 10, the lower portion of which is externally threaded as at 11 so that it can be turned into a pipe fitting in a fire extinguishing system. The apertured body member 10 defines a fluid delivery passageway 12 as seen in FIG. 2 of the drawings and the discharge end thereof is normally closed by a closure cap 13 and gasket 14. An orifice bushing 15 is positioned in the apertured body member 10 and the fluid delivering passageway 12 defined thereby so that various sizes of fluid delivering passageways may be easily provided by changing the orifice bushing 15 as will occur to those skilled in the art.

Figure 3:
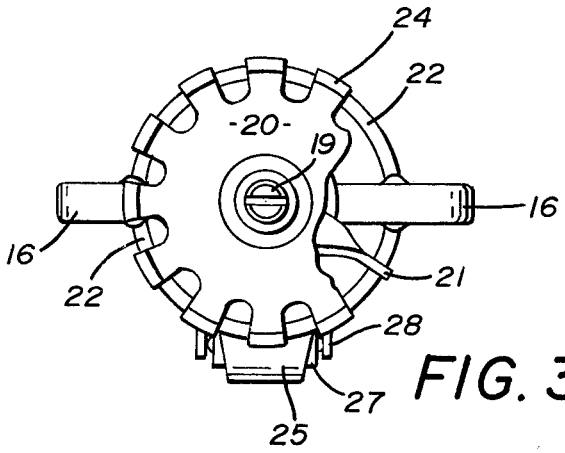
FIG. 3 is a top plan view of the device of the invention with parts broken away and parts in cross section.

Still referring to FIGS. 1 and 2 of the drawings, it will be seen that a frame formed of oppositely disposed spaced arms 16 is integrally formed with the body member 10 and the outer ends of the arms 16 are joined in an inverted conically shaped boss 17 which is provided with a passageway 18 in which a stakable compression screw 19 is positioned. A cylindrical extension is formed on the conical boss and the end of the screw 19 is rounded. An inverted conical deflector body 20 is positioned on the compression screw 19 is spaced relation to the conical shaped boss 17 on the arms 16 and a support spider 21 is secured to the bottom of the conical deflector body 20 so that circumferentially spaced portions thereof extend radially with respect to the compression screw 19. The extending portions of the spider 21 are shaped to minimize interference with water or other fluid flowing thereby and as may be seen by referring to FIG. 3 of the drawings.

A cylindrical ferrule 22 is secured to the outer ends of the spider 21 which positions the cylindrical ferrule is spaced relation to the uppermost portion of the conical shaped boss 17 and the cylindrical extension thereon and locates it with its uppermost peripheral edge in substantially the same transverse plane as the lowermost portion of the inverted conical deflector body 20 heretofore referred to. The upper portion of the conical deflector body 20 has a secondary deflector body 23 secured thereto and a plurality of upwardly and outwardly inclined tines 24 are arranged in circumferentially spaced relation on the secondary reflector body 23 as best seen in FIGS. 1 and 2 of the drawings.

The inner diameter of the cylindrical ferrule 22 is substantially equal to the outer diameter of the secondary deflector body 23 as defined at the base of the tines 24.

When the spray nozzle of the invention is utilized as an automatic spray nozzle as illustrated herein, the strut, lever and fusible element assembly hereinbefore referred to are positioned against the inner end of the compression screw 19 and arranged to hold the closure cap 13 on the apertured body member 10. The assembly comprises an inverted, generally L-shaped lever 25 which has a depression in its uppermost surface in which the lower end of the compression screw 19 is engaged. A substantially straight strut 26 is positioned on the closure cap 13 and engaged against the opposite side of the lever 25 with respect to its point of engagement with the compression screw 19. The arrangement is such that the lever 25 and the strut 26 are held in tensioned relation between the compression screw 19 and the closure cap 13 by a fusible element including a tubular body member 27 which is positioned between and in registry with a pair of apertured parallel arms which extend sidewardly from the strut 26. The lower end of the inverted substantially L-shaped lever 25 is thus held in desired tensioned relation so as to secure the strut 26 in a position holding the closure cap 13 on the apertured body member 10 of the spray nozzle.

When the device of the invention is used as an automatic spray nozzle, the fire extinguishing fluid, such as water, is contained by the closure cap 13 and upon the fusible material in the tubular member 27 attaining a fusing temperature such as 165 degrees F., the spheres in the end of the tubular member 27 will move inwardly thus freeing the fusible element from its position holding the inverted substantially L-shaped lever 35 as heretofore described. Upon such action occurring the strut 26 and the lever 25 and the closure cap 13 and gasket 14 will be focibly ejected from the positions illustrated in the drawings whereupon the fire extinguishing fluid will flow upwardly against the rounded point of the compression scdew 19 which is on the axial center line of the fluid passageway 12 of the spray nozzle and against the conical boss 17 and against the inverted conical deflector body 20, some of the fluid engaging the conical boss 17 is directed thereby against the inner surface of the cylindrical ferrule 22 which redirects the same upwardly and inwardly to the lower portion of the conical deflector body 20 and down into the central portion of the conical water pattern formed by the spray nozzle. The fluid engaging the conical boss 17, the extension thereon and the conical deflector 20 and the circumferentially spaced tines 24 and the the inner annular surface of the cylindrical ferrule 22 creates a spray pattern that forms a conical water distribution pattern in which a portion of the spraying fluid is directed into the central region of the conical pattern so as to produce a highly desirable uniform distribution of water throughout the conical pattern produced by the device.

It will thus be seen that a spray nozzle has been disclosed which incorporates several novel and practical deflector devices arranged as hereinbefore described to produce a highly desirable spray pattern in which there is a more uniform distribution of fluid than has heretofore been possible.

By referring again to FIG. 1 of the drawings, it will be seen that a bail 29 is shown with its ends engaged in openings in the straight strut 26 of the device, the bail being disclosed in U.S. Pat. No. 4,176,718 in which patent its utility in preventing the lodgement of the parts of the fusible element assembly in the deflector of the nozzle and/or sprinkler is described.

It will thus be seen that a novel and highly efficient spray nozzle has been disclosed and having thus described my invention what I claim is:

1. An improvement in a spray nozzle for distributing fluid in a spray pattern, the improvement comprising means for deflecting said fluid throughout an entire conical spray pattern, said spray nozzle comprising a body member having a fluid delivery passageway therethrough, oppositely disposed arms on said body member forming a frame outwardly of said fluid passageway and joined at their outer ends, a fitting positioned through a secondary passageway in said joined ends of said arms on the axial center line of said fluid delivery passageway, said means for deflecting said fluid through an entire conical spray pattern comprising an inverted conical deflector having a large end and a small end and positioned on said fitting with its small end adjacent said joined ends of said arms, a spider comprising at least two circumferentially spaced radially extending thin portions arranged with their smallest dimensions facing said fluid delivery passageway and positioned on said fitting between said joined ends of said arms and said conical deflector and a cylindrical ferrule on said outer ends of said radially extending thin portions of said spider coaxially positioned with respect to said fitting.

2. The spray nozzle of claim 1 and wherein said cylindrical ferrule is positioned with its lower annular edge substantially midway of said joined ends of said oppositely disposed arms and spaced radially with respect thereto.

3. The spray nozzle of claim 1 and wherein the large end of said inverted conical deflector is of a known diameter and wherein said cylindrical ferrule is of an inner diameter greater than the diameter of the large end of said conical deflector.

4. The spray nozzle of claim 1 and wherein a plurality of circumferentially spaced tines are formed on said conical deflector around the larger end thereof and extend outwardly thereof on an angle substantially the same as the angle of said conical deflector.

5. The spray nozzle of claim 1 and wherein said fitting is a compression screw.

6. The spray nozzle of claim 5 and wherein a closure on said fluid delivery passageway and an assembly comprising an inverted substantially L-shaped lever having a substantially horizontal position and a substantially vertical portion and a straight strut is positioned between said compression screw and said closure, a pair of spaced oppositely disposed sidewardly extending apertured arms on said straight strut and a horizontally disposed fusible material retaining means positioned between said apertured arms and partially engaged in the apertures therein, said substantially vertical portion of said inverted L-shaped lever being normally positioned between said apertured arms and between said straight strut and said fusible material retaining means, said fusible material means normally preventing relative motion of said lever with respect to said strut in said assembly and acting to free said lever from said strut upon attainment of a predetermined temperature.

7. The spray nozzle of claim 1 and wherein said inverted, conical deflector and cylindrical ferrule are arranged in vertically and horizontally spaced relation to the fluid delivery passageway and the axial center line thereof so as to direct fluid therebetween in a uniform conical spray distribution.

* * * * *